United States Patent [19]

McDanolds et al.

[11] 4,046,055

[45] Sept. 6, 1977

[54] APPARATUS FOR SAFELY NEUTRALIZING EXPLOSIVE DEVICES

[75] Inventors: Richard T. McDanolds; Rodney W. Jordan, both of Newton, N.J.

[73] Assignee: The United States of America as represented by the Secretary of the Army, Washington, D.C.

[21] Appl. No.: 601,239

[22] Filed: July 18, 1975

[51] Int. Cl.[2] ..... F42D 5/04

[52] U.S. Cl. ..... 86/1 B; 89/1 B; 102/1 R

[58] Field of Search ..... 89/1 R, 1 B; 102/1; 60/632–638; 86/1 B, 1 R

[56] References Cited

U.S. PATENT DOCUMENTS

| | | | |
|---|---|---|---|
| 1,131,761 | 3/1915 | Wheaton | 89/5 |
| 2,404,441 | 7/1946 | Hopkins | 89/1 R |
| 2,491,516 | 12/1949 | Piggot et al. | 89/1 B X |
| 3,054,349 | 9/1962 | Plumley | 102/1 R |
| 3,395,843 | 8/1968 | Kvavle | 60/632 X |
| 3,744,240 | 7/1973 | Henning | 60/634 |

*Primary Examiner*—Harold Tudor

*Attorney, Agent, or Firm*—Nathan Edelberg; A. Victor Erkkila; Thomas R. Webb

[57] ABSTRACT

An unknown explosive device is safely neutralized, that is, rendered inoperative, without disturbing the device, by penetrating the device with an explosive-driven captive projectile from a safe distance and injecting liquid nitrogen into the device through the projectile to cool some internal parts below the temperature at which they are operative.

7 Claims, 3 Drawing Figures

APPARATUS FOR SAFELY NEUTRALIZING EXPLOSIVE DEVICES

GOVERNMENTAL INTEREST

The invention described herein may be manufactured, used and licensed by or for the Government for governmental purposes without the payment to me of any royalty thereon.

BACKGROUND AND SUMMARY OF THE INVENTION

The present invention relates to an implement and system for safely neutralizing improvised explosive devices, such as homemade bombs planted by radicals, dissidents, revolutionaries and anarchists to either kill or destroy.

In the past, the Explosive Ordnance Disposal (EOD) man, or bomb disposal expert, was limited to using his hands or simple tools plus his experience to either carry the armed device to a safe disposal area or, as with Army EOD practices, gain access to the internal workings of the device and render the device safe at the site. In either case, the EOD man was subject to being seriously injured by the device functioning at any instant.

In accordance with the present invention, the explosive device is at least temporarily neutralized, at a safe distance, without any handling, by penetrating the device with an explosively-driven captive projectile and injecting a neutralizing fluid, such as liquid nitrogen, through the projectile, into the device.

DETAILED DESCRIPTION OF A PREFERRED EMBODIMENT

Figure 1:
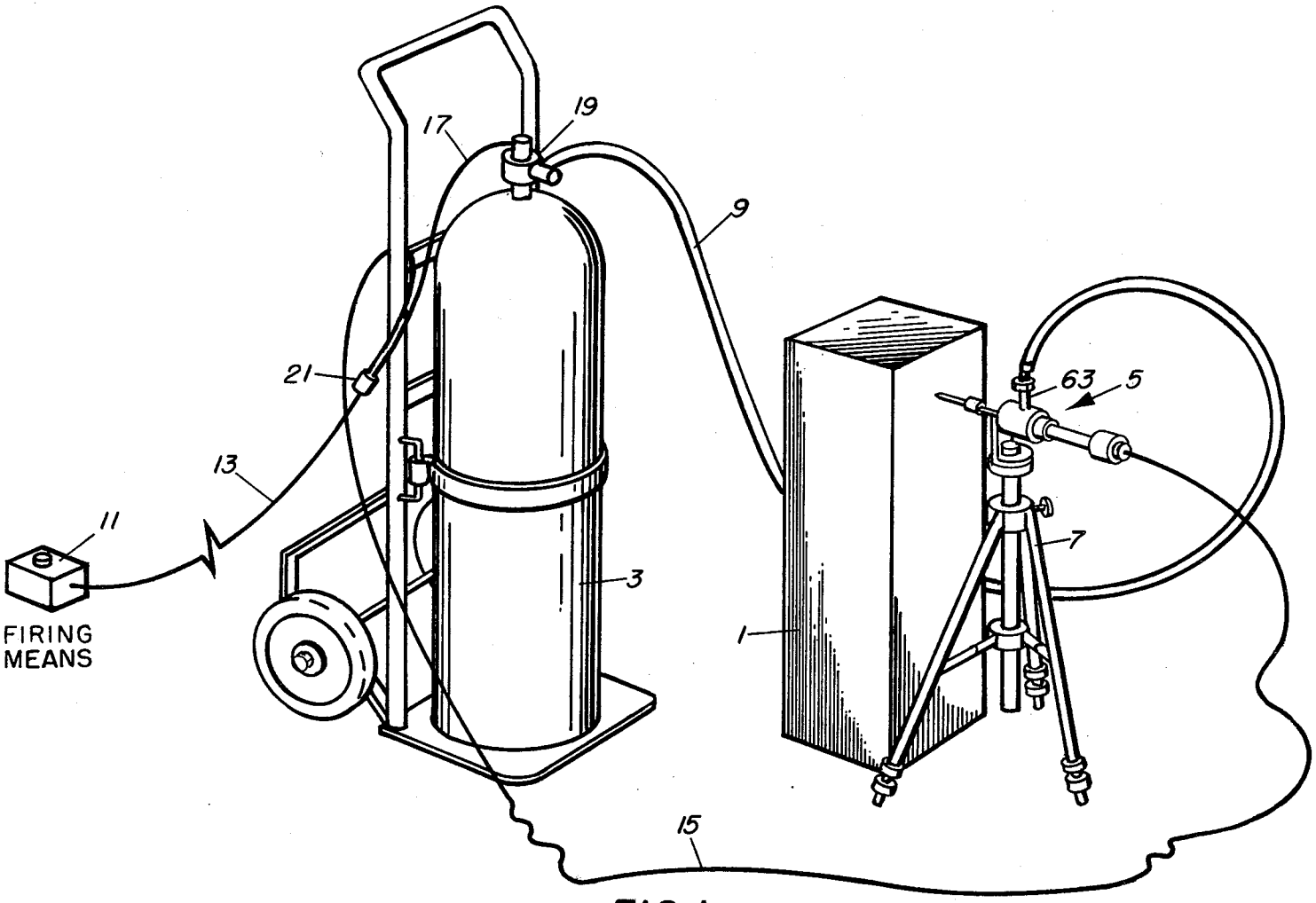
FIG. 1 is a perspective view of an apparatus for neutralizing an explosive device in accordance with the present invention.

FIG. 1 shows an unknown explosive device 1, in the form of a square box; a portable tank 3 containing a neutralizing fluid, such as liquid nitrogen, under pressure; an implement 5, mounted on a tripod 7 adjacent to the device 1 for penetrating the latter, and connected by a pressure hose 9 to the tank 3 for injecting neutralizing fluid into the device 1; and firing means 11 remote from the device 1 and electrically connected by cables 13, 15 and 17 to the implement 5 and tank valve 19 to actuate the implement and valve from a safe distance. The three cables are joined by a tee connector 21.

Figure 2:
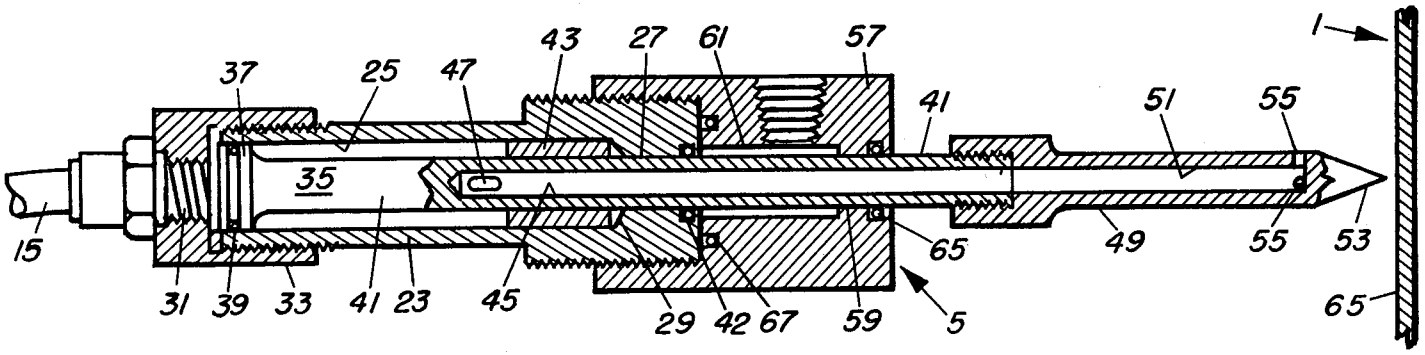
FIG. 2 is an enlarged axial section view of the explosive perforating and injecting device of FIG. 1, prior to actuation thereof.
Figure 3:
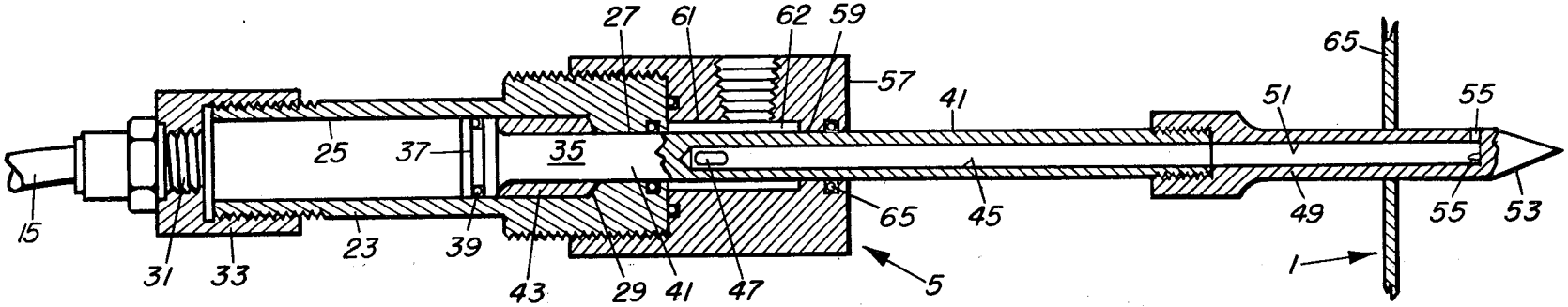
FIG. 3 is a view similar to FIG. 2, after actuation.

FIG. 2 shows the details of the implement 5 prior to actuation. The implement comprises a tubular gun body 23 having an elongated rear bore 25 of one diameter and a short forward bore 27 of smaller diameter connected by a tapered section 29. An explosive charge 31, in the form of an electrical squib or detonator, is mounted at the rear end of the gun body 23 within a charge chamber in a fitting 33 threaded onto the gun body. The cable 15 is operatively connected to the charge 31. A captive piston 35 has a cylindrical head portion 37 with an O-ring gas seal 39 slidably mounted in the rear bore 25 and a cylindrical rod or stem portion 41 slidably mounted in the forward bore 27, of the gun body 23, with an O-ring seal 42 therebetween. An annular buffer member 43, preferably of wood, is interposed between the head 37 and the reduced bore 27 to absorb the terminal force of the piston 35. The rod portion 41 is formed with an axial bore 45 which extends from a point just beyond the forward end of the gun body 23 when the piston is in its fired position (FIG. 3) through the forward end of the rod, and one or more radial openings 47 through the wall of the rod near the rear end of the bore 45. An elongated pointed piercing member 49, threaded onto rod portion 41, has an axial bore 51 which forms a continuation of bore 45 and extends to a point near but spaced from the point 53. A plurality of radial openings 55 provide communication between the bore 51 and the exterior of the member 49. A tubular member 57, threaded onto the forward end of the gun body 23, has a forward bore 59, of the same diameter as bore 27, through which the rod portion 41 is slidable, and a rear bore 61 of larger diameter which forms a plenum chamber 62 surrounding the rod portion 41 and communicating with the radial opening 47 in the forward position of the piston 35. Member 57 has a threaded inlet opening to receive the end fitting 63 of hose 9, and two O-rings seals 65 and 67 to prevent fluid leakage.

In operation, when an unknown explosive device is discovered, the implement 5 is mounted with the piston point 53 near, but spaced from, the exterior wall 65 of the device, by any suitable means, such as tripod 7, without disturbing the device in any manner. The tank 3 is located near the device with the hose 9 connected between the tank 3 and implement 5. The implement 5 and tank 3 are connected by cables 13, 15 and 17 and connector 21 to a conventional electrical firing device 11, located at a safe distance from the explosive device 1. When the firing device is actuated, the electric charge 31 is exploded, driving the piston forward in the gun body to the position shown in FIG. 3, wherein the member 49 pierces the wall 65 and exposes the openings 55 to the interior of the explosive device. At the same time, the valve 19 of tank 3 is opened and the neutralizing fluid is forced through the hose 9, plenum chamber 62, opening 47 and bores 45 and 51, into the explosive device. Preferably, the neutralizing fluid is liquid nitrogen (-320° F.), in which case, the fluid quickly cools the fuzing mechanism in the device below the temperature at which it will operate, thus rendering the device harmless for a time sufficient to disconnect it from the implement 5 and transfer it to a bomb disposal area or device, or to dismantle and disarm the device. Liquid nitrogen can be used with any kind of explosive device. If the kind of explosive material in the device is known, a known chemical neutralizer or sterilizer of the material can be used. Use of the wood buffer 43 prevents destruction of the implement when fired, and makes it possible to re-use it over and over, with a new charge 31 and new buffer 43 each time.

The foregoing disclosure and drawings are merely illustrative of the principles of this invention and are not to be interpreted in a limiting sense. We wish it to be understood that we do not desire to be limited to exact details of construction shown and described, because obvious modifications will occur to a person skilled in the art.

What is claimed is:

1. An implement for use in neutralizing an explosive device from a safe distance, comprising:

a gun body comprising a cylindrical bore and a contiguous cylindrical counterbore of reduced diameter;

a captive piston comprising a cylindrical head slidable in said bore, a contiguous cylindrical stem or rod of reduced diameter slidable in said counterbore and a pointed end extending forwardly therefrom; said piston being formed with a first transverse opening near said pointed end, a second transverse opening, and a longitudinal bore connecting said openings;

a charge chamber in said gun body adjacent to said cylindrical bore;

an electrically initiated explosive charge in said chamber for propelling said piston forwardly, to penetrate the wall of the explosive device to be neutralized;

a plenum chamber formed in said gun body surrounding an intermediate portion of said piston and in registration with said second transverse opening when said piston is in its forward position; and means for connecting said plenum chamber to a source of neutralizing fluid.

2. An implement as in claim 1, further comprising O-ring gas seals between said piston and said gun body.

3. An implement as in claim 1, further including an annular buffer member positioned within said cylindrical bore between said piston head and said counterbore.

4. An implement as in claim 1, wherein said means comprises a threaded opening for receiving a fluid coupling element.

5. A system for neutralizing an explosive device comprising:

an explosive device;

an implement comprising:

a gun body comprising a cylindrical bore and a contiguous cylindrical counterbore of reduced diameter;

a captive piston comprising a cylindrical head slidable in said bore, a contiguous cylindrical stem or rod of reduced diameter slidable in said counterbore and a pointed end extending forwardly therefrom and positioned adjacent to said explosive device; said piston being formed with a first transverse opening near said pointed end, a second transverse opening, and a longitudinal bore connecting said openings;

a charge chamber in said gun body adjacent to said cylindrical bore;

an electrically initiated charge in said chamber for propelling said piston forwardly, to penetrate the wall of said explosive device;

a plenum chamber formed in said gun body surrounding an intermediate opening when said piston is in its forward position; and means for connecting said plenum chamber to a source of neutralizing fluid;

a container of neutralizing fluid;

fluid conducting means connecting said container with said connecting means of said implement; and electrical means, located at a safe distance from said device and electrically connected with said explosive charge of said implement, for initiating said explosive charge to cause said piston to penetrate said explosive device.

6. A system as in claim 5, further comprising an electrically-actuated valve in said fluid conducting means, and means electrically connecting said electrical initiating means with said valve for simultaneous opening of said valve and initiation of said explosive charge.

7. A system as in claim 5, wherein said container and fluid conducting means are cryogenic, and said fluid is liquid nitrogen, whereby said explosive device is neutralized by cooling internal parts thereof below the temperature at which they cease to function.

* * * * *